US006071157A

United States Patent [19]

Yoshino et al.

[11] Patent Number: 6,071,157

[45] Date of Patent: Jun. 6, 2000

[54] TRIMMING DEVICE FOR MARINE PROPULSION UNIT

[75] Inventors: Hisayoshi Yoshino; Akihiro Onoue, both of Shizuoka, Japan

[73] Assignee: Sanshin Kogyo Kabushiki Kaisha, Japan

[21] Appl. No.: 09/249,195

[22] Filed: Feb. 12, 1999

[30] Foreign Application Priority Data

Feb. 12, 1998 [JP] Japan ..... 10-029587

[51] Int. Cl.[7] ..... B63H 5/125

[52] U.S. Cl. ..... 440/61

[58] Field of Search ..... 440/53, 61; 384/42; 92/165 AR, 121, 167

[56] References Cited

U.S. PATENT DOCUMENTS 4,720,278 1/1988 Taguchi et al. .

4,764,134 8/1988 Watanabe .

5,416,154 5/1995 Ferdani ..... 524/494

5,735,610 4/1998 Mark et al. ..... 384/42

*Primary Examiner*—Ed Swinehart

*Attorney, Agent, or Firm*—Knobbe, Martens, Olson & Bear, LLP

[57] ABSTRACT

An improved thrust taking arrangement for an outboard drive includes an anti-friction member that transfers the thrust between the trim adjusting thrust member and the outboard drive. The anti-friction member is attached on the thrust taking member and is made of a material having a smaller coefficient of friction than both of the thrust member and the thrust taking member for reducing friction upon reciprocation of the thrust member.

14 Claims, 3 Drawing Sheets

TRIMMING DEVICE FOR MARINE PROPULSION UNIT

BACKGROUND OF THE INVENTION

1. Field of the Invention

This invention relates to a trimming device for a marine propulsion unit and more particularly to an improved connection between the trimming device and the propulsion unit.

2. Description of Related Art

In a wide variety of outboard drives, both outboard motors and the outboard drive section of an inboard/outboard drive, there is an arrangement incorporated for adjusting the trim position of the pivotally supported outboard drive. In one form of powered trim adjustment, a trim cylinder is carried by the transom of the watercraft and has an actuating rod or thrust member that engages the outboard drive and which urges it about its pivotal axis to change the trim position. In addition, the thrust member of the trim unit takes the driving thrust from the outboard drive during forward propulsion. Normally, the thrust member reciprocates along a fixed axis whereby the outboard drive pivots about a fixed axis. As a result of this, there will be relative movement between the thrust member and the outboard drive that can cause noise during operation. In addition, such relative movement results in wear, galling and other unsatisfactory conditions.

FIG. 1 illustrates the interaction between the thrust member and the outboard drive to further explain the disadvantages associated with prior trim adjust mechanisms. In particular, FIG. 1 illustrates, in isolation, thrust member (trim piston rod) 1 that reciprocates along a fixed axis 2, while a thrust taking member 3 is affixed to a front 4 of a swivel bracket along a fixed axis 5. The swivel bracket is a part of an outboard drive and will be described later. The axes 2, 5 are skewed relative to each other and an angle defined between the axes 2, 5 varies with the reciprocation of the thrust member 1. Accordingly, a contact point of the thrust member 1 with the thrust taking member 3 gradually shift. Because of this, the thrust member 1 generally has a round convex surface 6 at the end portion thereof and the thrust taking member 3 has a round concave surface 7 that cooperates with the convex surface 6 of the thrust member 1. Due to the skewed orientation of the axes 2, 5, a couple of components Fx and Fy of the force F occur. The force component Fx, in particular, becomes larger along with the expansion of the thrust member 1 and when the thrust member 1 is fully extended, that is, when the outboard drive is lifted to the uppermost position, the force component Fx also reaches its maximum. The force component Fx works to bend the thrust member 1. While the degree of deflection of the thrust member 1 may be slight and not damage the thrust member 1 because of its stiffness, such deflection can cause noise and other disadvantages, as noted above.

One way to avoid such disadvantages would be to incorporate a grease fitting. However, this requires servicing and posses the potential of dirtying an operator's hands and clothes. In addition, the grease may be depleted and if not promptly replaced, the same disadvantages can result again.

In order to resolve these problems, some attempts were made as disclosed in U.S. Pat. Nos. 4,720,278 and 4,764,134. These inventions, however, require somewhat complicated structures and hence tend to invite frequent exchanges of parts or components.

SUMMARY OF THE INVENTION

A need therefore exists for an improved trim adjust system for an outboard drive that reduces the noise produced when the outboard motor is raised or lowered, and that improves the wear of the components which effect the trim or tilt adjust movement.

One aspect of the present invention thus involves a tilt and trim adjustment mechanism for an outboard drive that is mounted for pivotal movement through a plurality of trim adjusted positions relative to a transom of an associated watercraft. The tilt and trim adjustment mechanism includes a thrust taking member and a thrust motor having a reciprocating thrust member. The thrust taking member and the trim motor operate between the outboard drive and the transom of the watercraft, and are arranged such that the reciprocating member bears against the thrust taking member for effecting pivotal movement of the outboard drive relative to the transom upon reciprocation of the thrust member. An anti-friction member is positioned between the thrust taking member and the reciprocating member. The anti-friction member is made of a material having a smaller coefficient of friction than that of the thrust taking member, and more preferably smaller than that of both the thrust taking member and the reciprocating thrust member. In this manner, friction between the reciprocating thrust member and the thrust taking member is reduced.

In accordance with another aspect of the present invention, a thrust taking member is provided for a tilt and trim adjust mechanism. The thrust taking member comprises a threaded shank and a head. The shank and the head are unitarily formed of a corrosion-resistant material. The head has at least two driving flats. An anti-friction member is fixed to the head on the side of the head that is opposite the side from which the shank projects. The anti-friction member is made of material that has a smaller coefficient of friction than that of the material forming the shank and the head.

Further aspects, features and advantages of the present invention will become apparent from the detailed description of the preferred embodiment which follows.

BRIEF DESCRIPTION OF THE DRAWINGS

As noted above.

FIG. 2 is a partial side elevational view showing an outboard motor attached to the transom of a watercraft (shown partially and in section).

FIG. 3 is an enlarged elevational view showing the tilt and trim adjustment mechanism looked generally from the outboard drive unit.

FIG. 4 is a cross-sectional view partially showing a contact of the reciprocating thrust member with a thrust taking member of this invention.

FIG. 5 is a front view of the thrust taking member.

FIG. 6 is a side elevational view of the thrust taking member (shown partially in section).

DETAILED DESCRIPTION OF A PREFERRED EMBODIMENT OF THE INVENTION

Figure 1:
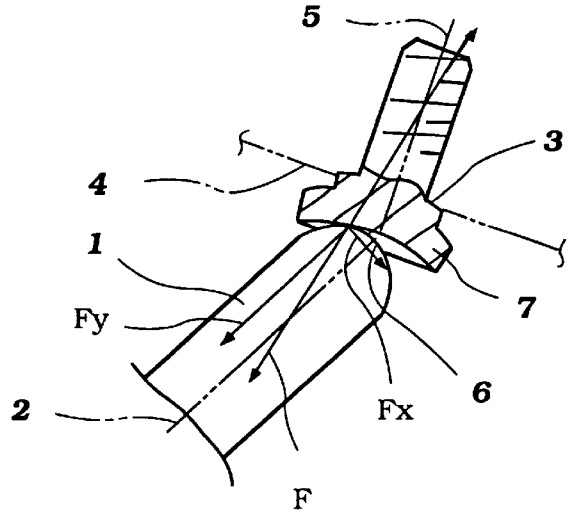
FIG. 1 illustrates a prior thrust taking member (shown partially in cross-section) and illustrates the interaction between the thrust taking member and a reciprocating thrust member. This figure is provided in order to assist the reader's understanding of the prior art and for the reader to better appreciate the aspects, features and advantages associated with the present invention.
Figure 2:
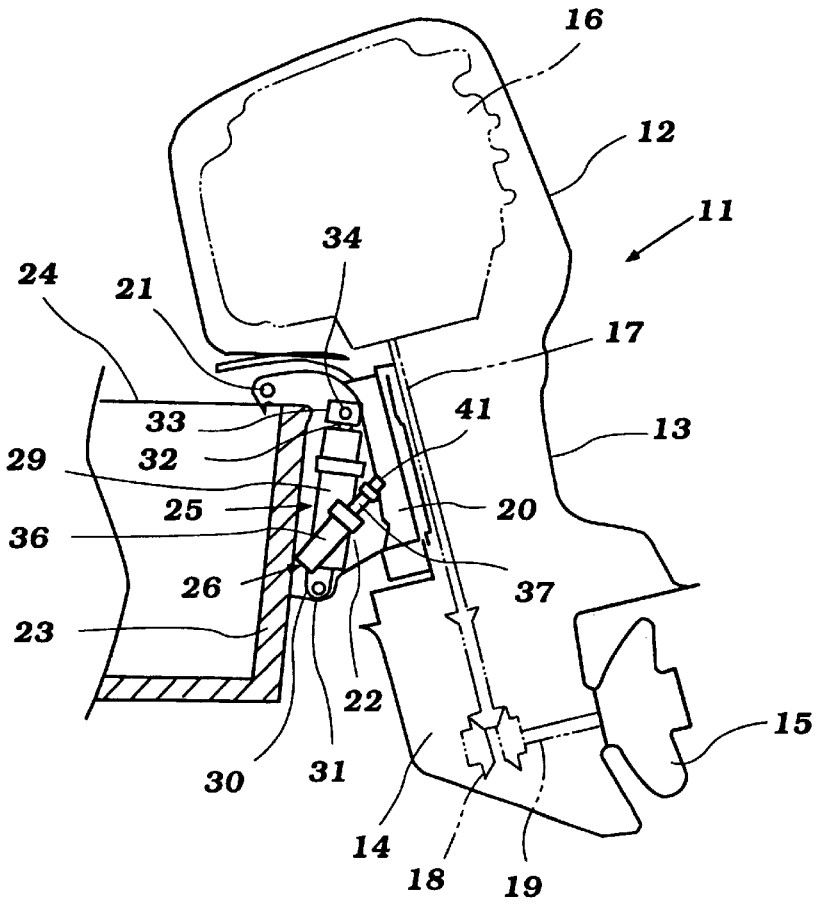
FIGS. 2 through 6 illustrate a preferred embodiment of the present trim adjust system. The above-mentioned and other features of the invention will now be described with reference to this embodiment, which is intended to illustrate, but not to limit, the present invention. The following further describes these figures of this embodiment.
Figure 3:
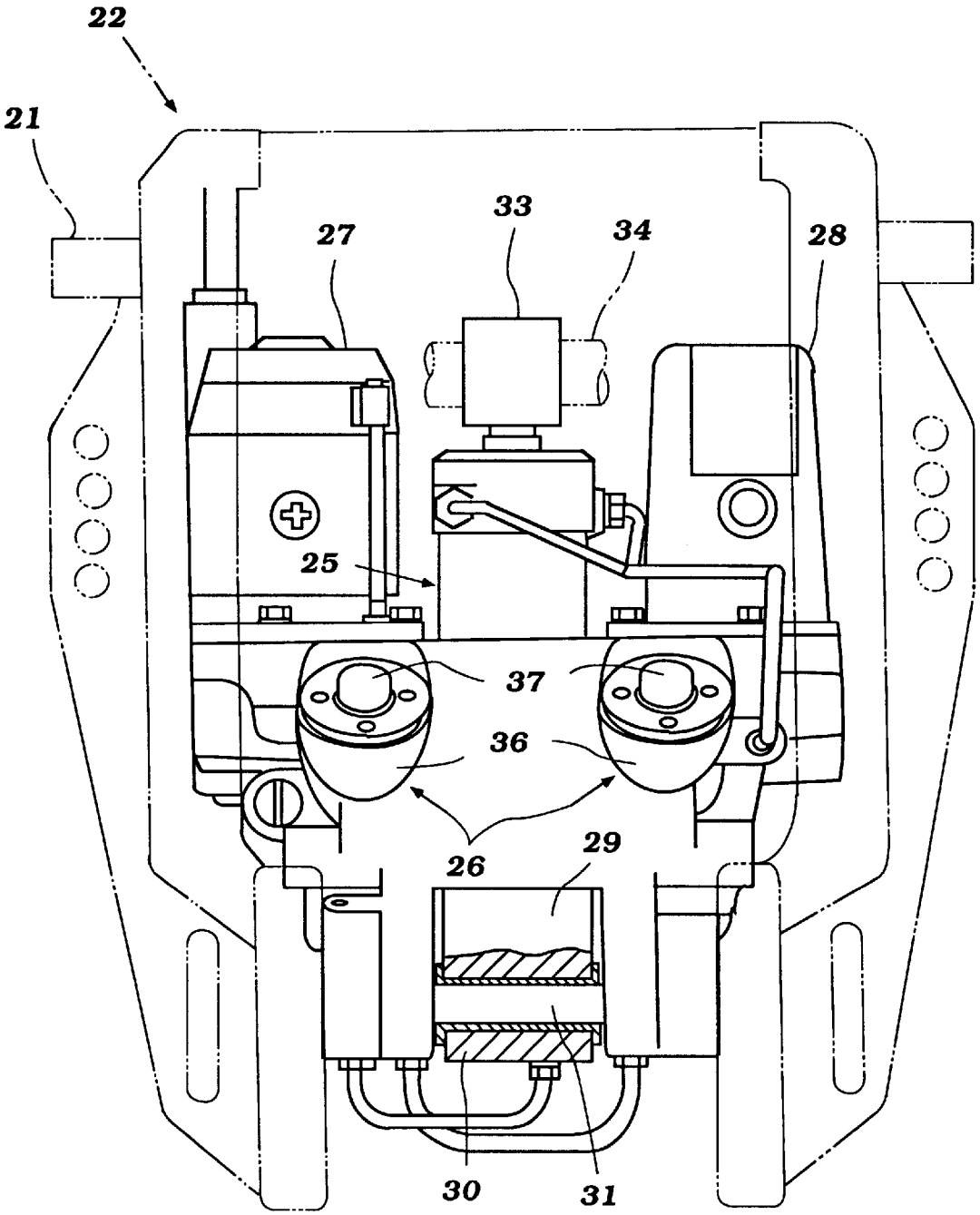

With reference initially to FIGS. 2 and 3, the general environment in which the invention may be practiced is illustrated. An outboard motor, indicated generally by the reference numeral 11, comprises the outboard drive in this embodiment. The term "outboard drive" is utilized to describe either an outboard motor or the outboard drive portion of an inboard/outboard drive.

The outboard motor 11 includes a power head 12 and a drive shaft housing 13 that depends from the power head 13. A lower unit 14 is provided at the lower end of the drive shaft housing 13 and supports the propeller 15. The power head 12 accommodates a combustion engine 16 therein and the drive shaft housing 13 contains a drive shaft 17 that extends from the engine 16 to a bevel gear 18 in the lower unit 14. The bevel gear transmits power from the engine 16 to the propeller 15 through a propeller shaft 19. In this manner, the engine 16 drives the propeller 15 (or another type of propulsion device).

A steering shaft (not shown) is fixed in a known manner to the drive shaft housing 13 and is journaled for steering movement about a generally vertically extending axis within a swivel bracket 20. The swivel bracket 20, in turn, is pivotally connected by means of a pivot pin 21 to a clamping bracket 22. The pivot pin 21 permits tilting movement of the outboard drive 11 about the horizontally disposed axis defined by the pivot pin 21 for either trim adjustment or for tilt-up of the outboard drive 11. The cramping bracket 22 is affixed to a transom 23 of a watercraft 24 in a known manner.

A tilt and trim adjustment mechanism operates between the outboard motor 11 and the transom 23 to effect tilt and trim movement. As is conventional, the tilt and trim adjustment mechanism operates between the clamping bracket 22 and the swivel bracket 20. In the illustrated embodiment, the tilt and trim adjustment mechanism includes a tilt cylinder assembly 25 and a trim cylinder assembly 26. Tilting movement of the outboard drive 11 is controlled primarily by means of the tilt cylinder assembly 25 while the trim condition of the outboard drive 11 is controlled primarily by a trim cylinder assembly 26. The tilt and trim adjust mechanism, however, can include a cylinder assembly that effects movement of the outboard motor both through a trim range of movement and to a fully tilted up position.

The tilt cylinder assembly 25 and trim cylinder assembly 26 are both powered by pressurized working fluid delivered by a fluid pump 27 (see FIG. 3). The pump 27 is driven by a reversible electric motor (not shown) in a known manner. A fluid reservoir 28 communicates with the fluid pump 27. The structure of the outboard drive 11 and its tilt and trim arrangement as thus far described may be considered to be conventional.

The tilt cylinder assembly 25 includes a cylinder housing 29 that is formed with a trunnion 30. The trunnion 30 is pivotally connected to the clamping bracket 22 by means of a pivot pin 31. The cylinder housing 29 is divided into a pair of fluid chambers by a piston (not shown) to which a piston rod 32 is connected. The piston rod 32 extends through the upper end of the cylinder housing and has, affixed to it, a connecting member 33. The connecting member 33 is pivotally connected to the swivel bracket 20 by means of a pivot pin 34. It should be readily apparent, therefore, that extension and retraction of the piston rod 32 will effect pivotal movement of the swivel bracket 20 relative to the clamping bracket 22 for pivoting the outboard drive 11 about the pivot pin 21. The tilt cylinder assembly 25 is a high speed, low force fluid motor and is normally employed for pivoting the outboard drive 11 from a trim up condition to a tilted up out of the water condition.

The trim cylinder assembly 26 is affixed to a clamping bracket 22. The trim cylinder assembly 26 includes a pair of cylinder housings 36 that are disposed on either side of the tilt cylinder assembly 25. Like the tilt cylinder 29, the trim cylinder housing 36 is divided into an upper and lower section by a piston (not shown). The trim cylinder housing 36, however, is rigidly affixed to the cramping bracket 22. A piston rod 37 (i.e., the reciprocating thrust member), is rigidly affixed to the piston of the trim cylinder assembly 35. This trim piston rod 37 normally bears directly against the swivel bracket 20 for effecting its pivotal movement. The piston rod 37 reciprocates along a fixed axis while the swivel bracket 20 pivots about the pivot pin 21. The piston rod 37 has the round convex surface 38 at the end portion thereof.

Figure 4:
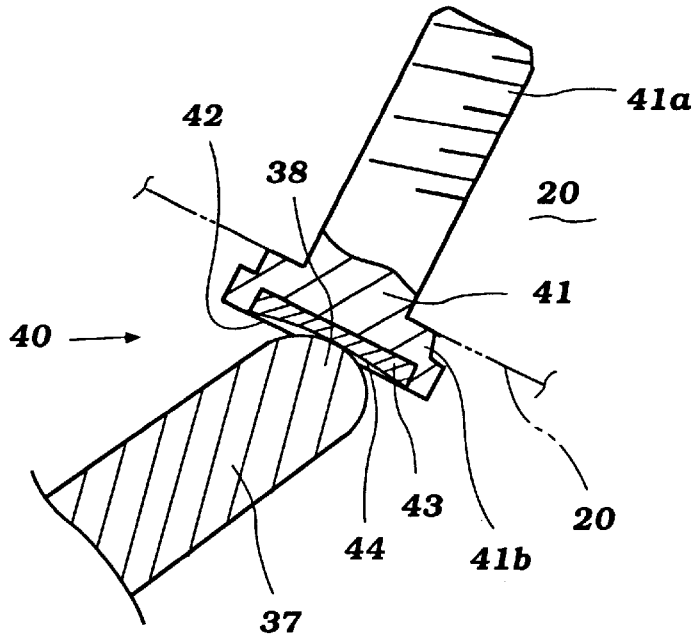
Figure 5:
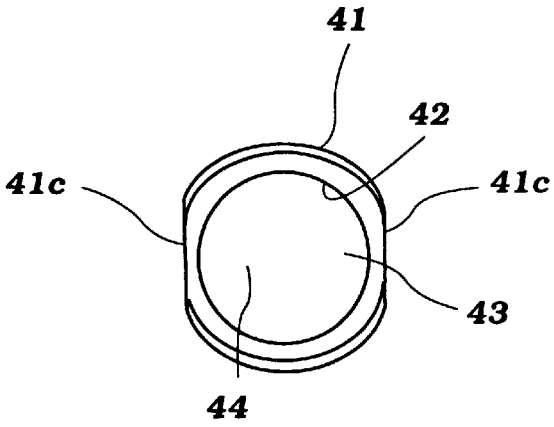
Figure 6:
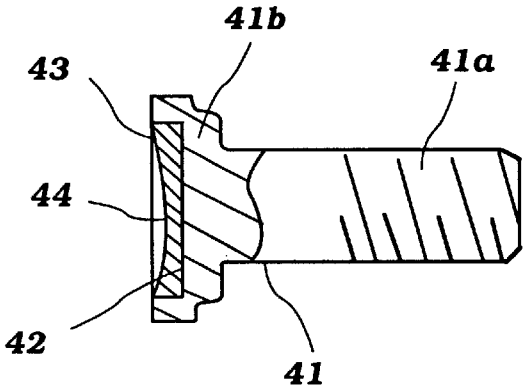

With reference now to FIGS. 4, 5 and 6, an anti-friction thrust arrangement, indicated generally by the reference numeral 40, is provided for transferring thrust forces between the piston rod 37 and the swivel bracket 20. Thus, a dedicated anti-friction thrust arrangement 40 cooperates with each of the piston rods 37 of the trim cylinder assembly 26. The following description of one of the anti-friction arrangements 40 and its operation and assembly is meant to apply equal to the other.

A thrust taking member 41 of the arrangement 40 is formed as a screw and is affixed to a front side of the swivel bracket 20, as understood from FIG. 4. If, however, the trim cylinder housings 36 were affixed to the swivel bracket 20, rather than to the clamping bracket 22 as in the present embodiment, the thrust taking member 41 would be affixed to the clamping bracket 22.

In the illustrated embodiment, the thrust taking member 41 includes a threaded shank 41*a* and a head 41*b*. The head 41*b* includes at least two driving flats 41*c* (FIG. 5) that permits the thrust taking member 41 to be rotated by a tool during installation or removal. The head 41*b* and shank 41*a* of the thrust taking member 41 are preferably formed in a unitary manner of a material of suitable strength, such as, for example, a metal (e.g., steel or brass). The material also is desirably corrosion-resistant (e.g., stainless steel); however, the thrust taking member 41 of course can be formed of other suitable materials.

An anti-friction member 43 is provided between the trust taking member 41 and the end 38 of the piston rod 37. While in the illustrated embodiment the anti-friction member 43 is attached to the thrust taking member 41, the anti-friction member 43 can be attached, in addition or in the alternative, to the end of the piston rod 37.

In the illustrated embodiment, the anti-friction member 43 is inlaid into the head 41*b* of the thrust taking member 41. For this purpose, the thrust taking member 41 has a recess 42 that is formed on a side of the screw head 41*b* opposite of the side from which the shank 41*a* projects. The recess 42 has a relatively shallow cylindrical shape with a flat bottom.

The anti-friction member 43 in the illustrated embodiment has a generally disc-like shape of a diameter that generally matches that of the recess 42. As best seen in FIGS. 4 and 6, an inner surface of the anti-friction member 43 has a flat bottom surface that sits flush against the bottom of the recess 42. The anti-friction member 43 also has a round concave face 44 to cooperate with the convex surface of the piston rod end 38.

The anti-friction member 43 preferably is made of material that has a smaller coefficient of friction than that of the thrust taking member 41, and more preferably a coefficient of friction less than that of both the thrust taking member 41 and the piston rod end 38. The material also desirably has a wear-resistant property, but allows for a certain amount of wear loss. A synthetic resin is a suitable material from which to make the anti-friction member 43. It is preferable to use, as the synthetic resin, fluorine-based polymers (for instance, 60 to 75% by weight) that contain carbon graphite (the rest of weight).

The anti-friction member 43 is inlaid into the recess 42 and affixed therein. In accordance with a preferred method of affixing the anti-friction member within the recess 42, the anti-friction thrust arrangement 40 is heated in a baking process. The anti-friction member 42 melts at the interface between the anti-friction member 43 and the walls of the recess 42 during this process. The molten material flows into and between surface geometric irregularities (e.g., cracks, nicks, scratches, ridges, peaks and valleys) on the walls of the recess 42 so as to interlock together the anti-friction member 43 and the thrust taking member 41. The anti-friction member 43, however, can be secured within the recess 42 by other means, such as, for example, by an adhesive, set screw, pin(s) or the like.

In trimming up operations, the piston rod 37 extends along the axis and contacts the thrust taking member 41 so as to lift the outboard drive 11 upwardly. In trimming down operations, on the other hand, the piston rod 37 and the drive member 13 move in the opposite direction. With the movements of the piston rod 37, a contact point of the piston rod 37 with the thrust taking member 41 gradually shift due to the varying angles of intersect, as described with the conventional arrangement. In other words, the round convex face 38 of the piston rod 37 slides on the round concave surface 44 of the thrust taking member 41. Because of the anti-friction member 43, however, neither noise nor galling occurs.

As described above, the anti-friction member 43 allows a certain amount of wear loss. This nature is useful for rectifying dispersion caused in producing the anti-friction member 43 itself. That is, roughness of this member 43 is gradually scraped off during frequent shifts of the contact point. Accordingly, the round concave face 44 will increasingly fit with the round convex face 38. This means that the bearing stress between them decreases and hence sliding contacts with each other is improved further.

In addition, the round convex surface 38 is likely to corrode and cause roughness thereon due to salinity in seawater, especially where the associated watercraft is moored. The same rectification occurs on the convex surface 38, however, and the contact of the faces 38, 44 will be again improved. It should be noted that the wear loss of the anti-friction member 43 is very small and after the rectification no further wear occurs.

The anti-friction member 43, unlike a grease fitting, is not washed away by waves or contact. Thus, noise, galling and wear can be prevented from occurring for an extended period of time. In addition, the anti-friction member 43 does not require servicing nor does it dirty an operator's hands and clothes.

Also, since the anti-friction member 43 is inlaid into the cylindrical recess 42 and affixed there in the baking process, it is positioned accurately and rigidly. Further, the carbon graphite contained in the synthetic resin of the anti-friction member 43 expedites slipperiness and strength against bearing stresses.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A tilt and trim adjustment mechanism for a marine outboard drive mounted for pivotal movement through a plurality of trim adjusted positions relative to a transom of an associated watercraft, comprising thrust taking member, a trim motor having a reciprocating thrust member, the thrust taking member and the trim motor being operable between the outboard drive and the transom of the watercraft, and being arranged such that the reciprocating thrust member bears against the thrust taking member for effecting pivotal movement of the outboard drive member relative to the transom upon reciprocation of the thrust member, and an anti-friction member positioned between the thrust taking member and the reciprocating thrust member, the anti-friction member being made of a material having a smaller coefficient of friction than that of the thrust taking member for reducing friction upon reciprocation of the thrust member, the anti-friction member is attached to the thrust taking member, the thrust taking member having a recess, and the anti-friction member being placed in the recess.

2. A tilt and trim adjustment mechanism as set forth in claim 4, wherein the material of the anti-friction member has a smaller coefficient of friction than that of said reciprocating thrust member.

3. A tilt and trim adjustment mechanism as set forth in claim 1, wherein the recess has a cylindrical shape.

4. A tilt and trim adjustment mechanism as set forth in claim 1, wherein the anti-friction member is formed of a wear resistant material.

5. A tilt and trim adjustment mechanism as set forth in claim 1, wherein both of the thrust taking member and the reciprocating thrust member are made of metal and the anti-friction member is made of synthetic resin.

6. A tilt and trim adjustment mechanism for a marine outboard drive mounted for pivotal movement through a plurality of trim adjusted positions relative to a transom of an associated watercraft, comprising a thrust taking member, a trim motor having a reciprocating thrust member, the thrust taking member and the trim motor being operable between the outboard drive and the transom of the watercraft, and being arranged such that the reciprocating thrust member bears against the thrust taking member for effecting pivotal movement of the outboard drive member relative to the transom upon reciprocation of the thrust member, and an anti-friction member positioned between the thrust taking member and the reciprocating thrust member, the anti-friction member being made of a material having a smaller coefficient of friction than that of the thrust taking member for reducing friction upon reciprocation of the thrust member, the reciprocating thrust member of the outboard drive member having a round convex surface at an end portion thereof, and the anti-friction member having a round concave surface to cooperate with the convex surface of the reciprocating thrust member.

7. A tilt and trim adjustment mechanism as set forth in claim 6, wherein the anti-friction member is attached to the thrust taking member.

8. A tilt and trim adjustment mechanism for a marine outboard drive mounted for pivotal movement through a plurality of trim adjusted positions relative to a transom of an associated watercraft, comprising a thrust taking member, a trim motor having a reciprocating thrust member, the thrust taking member and the trim motor being operable between the outboard drive and the transom of the watercraft, and being arranged such that the reciprocating thrust member bears against the thrust taking member for effecting pivotal movement of the outboard drive member relative to the transom upon reciprocation of the thrust member, and an anti-friction member positioned between the thrust taking member and the reciprocating thrust member, the anti-friction member being made of a material having a smaller coefficient of friction than that of the thrust taking member for reducing friction upon reciprocation of the thrust member, the anti-friction member being made of a fluorine-based polymer containing carbon graphite.

9. A thrust taking arrangement for a tilt and trim adjustment mechanism comprising a thrust taking member including a threaded shank and a head, the shank and the head being unitarily formed of a corrosion-resistant material, and an anti-friction member fixed to the head on a side of the head that is opposite of the side from which the shank projects, the anti-friction member being made of a material having a smaller coefficient of friction than that of the material forming the shank and the head, and the anti-friction member having a rounded convex surface.

10. A thrust taking arrangement for a tilt and trim adjustment mechanism comprising a thrust taking member including a threaded shank and a head, the shank and the head being unitarily formed of a corrosion-resistant material, and an anti-friction member fixed to the head on a side of the head that is opposite of the side from which the shank projects, the anti-friction member being made of a material having a smaller coefficient of friction than that of the material forming the shank and the head, and the head including a recess and the anti-friction member being located within the recess.

11. A thrust taking arrangement as in claim 10, wherein the anti-friction member is formed of a wear-resistant material.

12. A thrust taking arrangement as in claim 10, wherein the shank and head are formed of a metal material and the anti-friction member is made of a synthetic resin.

13. A thrust taking arrangement for a tilt and trim adjustment mechanism comprising a thrust taking member including a threaded shank and a head, the shank and the head being unitarily formed of a corrosion-resistant material, and an anti-friction member fixed to the head on a side of the head that is opposite of the side from which the shank projects, the anti-friction member being made of a material having a smaller coefficient of friction than that of the material forming the shank and the head, and the anti-friction member is made of a fluorine-based polymer containing carbon graphite.

14. A thrust taking arrangement for a tilt and trim adjustment mechanism comprising a thrust taking member including a threaded shank and a head, the shank and the head being unitarily formed of a corrosion-resistant material, and an anti-friction member fixed to the head on a side of the head that is opposite of the side from which the shank projects, the anti-friction member being made of a material having a smaller coefficient of friction than that of the material forming the shank and the head, and the head has at least two driving flats.

* * * * *